US009892842B2

(12) United States Patent
Vafakhah et al.

(10) Patent No.: US 9,892,842 B2
(45) Date of Patent: Feb. 13, 2018

(54) INDUCTOR ASSEMBLY SUPPORT STRUCTURE

(71) Applicant: Ford Global Technologies, LLC, Dearborn, MI (US)

(72) Inventors: Behzad Vafakhah, Ann Arbor, MI (US); Shailesh Shrikant Kozarekar, Novi, MI (US); Shahram Zarei, Farmington Hills, MI (US); Brandon Dobbins, Grosse Pointe Shores, MI (US); Vincent Skalski, Plymouth, MI (US); Sudhir Kumar, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 421 days.

(21) Appl. No.: 13/834,416

(22) Filed: Mar. 15, 2013

(65) Prior Publication Data

US 2014/0266527 A1 Sep. 18, 2014

(51) Int. Cl.

| | |
|---|---|
| ***H01F 27/02*** | (2006.01) |
| ***H01F 27/06*** | (2006.01) |
| ***H01F 3/14*** | (2006.01) |
| ***H01F 27/32*** | (2006.01) |
| *H01F 27/10* | (2006.01) |

(52) U.S. Cl.

CPC ..... *H01F 27/06* (2013.01); *H01F 3/14* (2013.01); *H01F 27/325* (2013.01); *H01F 27/105* (2013.01)

(58) Field of Classification Search

CPC ..... H01F 38/12; H01F 27/022; H01F 27/02

USPC ..... 336/90, 92, 94, 96, 98

See application file for complete search history.

(56) References Cited

U.S. PATENT DOCUMENTS

| | | | |
|---|---|---|---|
| 1,579,049 | A | 3/1926 | Ainsworth |
| 2,608,610 | A | 8/1952 | Thulin |
| 3,162,829 | A | 12/1964 | Snelling |
| 3,184,564 | A | 5/1965 | Ryckman et al. |
| 3,195,086 | A | 7/1965 | Taylor |

(Continued)

FOREIGN PATENT DOCUMENTS

| | | | |
|---|---|---|---|
| CA | 1210464 A | 8/1986 | |
| CA | 2781203 A1 * | 5/2011 | ..... C21D 8/1272 |

(Continued)

OTHER PUBLICATIONS

Salem et al., "Power Module Cooling for Future Electric Vehicle Applications: A Coolant Comparison of Oil and PGW," US Naval Academy, Annapolis, MD (2006) pp. 1-4.

(Continued)

*Primary Examiner* — Tsz Chan

(74) *Attorney, Agent, or Firm* — David Kelley; Brooks Kushman P.C.

(57) ABSTRACT

A vehicle is provided with a transmission and an inductor assembly that is mounted within a chamber of the transmission. The inductor assembly includes a coil, a core and an insulator having first and second portions that are oriented toward each other. Each portion includes a base, a support extending from the base, and a spool extending transversely from the support to engage the other portion. Each spool includes an external surface for supporting the coil and a cavity extending therethrough for receiving the core.

16 Claims, 10 Drawing Sheets

(56) References Cited

U.S. PATENT DOCUMENTS

| | | | | |
|---|---|---|---|---|
| 3,197,167 | A | 7/1965 | Sturgis | |
| 3,261,905 | A | 7/1966 | Allen | |
| 4,123,677 | A | 10/1978 | Laskaris et al. | |
| 4,150,278 | A | 4/1979 | Resener | |
| 4,282,567 | A | 8/1981 | Voigt | |
| 4,485,367 | A | 11/1984 | Hashizume | |
| 4,549,158 | A | 10/1985 | Mitsui | |
| 4,577,175 | A | 3/1986 | Burgher et al. | |
| 4,581,477 | A | 4/1986 | Harumoto et al. | |
| 5,352,853 | A | 10/1994 | Takagi | |
| 6,384,703 | B1 * | 5/2002 | Ramos et al. | 336/58 |
| 6,392,519 | B1 | 5/2002 | Ronning | |
| 6,688,383 | B1 | 2/2004 | Sommer et al. | |
| 6,772,603 | B2 | 8/2004 | Hsu et al. | |
| 7,009,317 | B2 | 3/2006 | Cronin et al. | |
| 7,561,429 | B2 | 7/2009 | Yahata et al. | |
| 7,823,669 | B2 | 11/2010 | Bandai et al. | |
| 8,009,004 | B2 | 8/2011 | Ahangar et al. | |
| 8,201,650 | B2 | 6/2012 | Yoshida | |
| 8,215,003 | B2 | 7/2012 | Saka et al. | |
| 2003/0098769 | A1 | 5/2003 | Cheung et al. | |
| 2004/0032312 | A1 | 2/2004 | Yu et al. | |
| 2004/0045749 | A1 | 3/2004 | Jaura et al. | |
| 2004/0184292 | A1 * | 9/2004 | Knox | 363/58 |
| 2006/0103256 | A1 | 5/2006 | Welke | |
| 2007/0075812 | A1 | 4/2007 | Su et al. | |
| 2009/0108971 | A1 * | 4/2009 | Okamoto | 336/65 |
| 2010/0072865 | A1 * | 3/2010 | Endo et al. | 310/68 D |
| 2010/0175933 | A1 * | 7/2010 | Yoshida | 180/65.1 |
| 2010/0245016 | A1 | 9/2010 | Kameda et al. | |
| 2011/0068506 | A1 | 3/2011 | Kusawake et al. | |
| 2011/0121935 | A1 | 5/2011 | Chu et al. | |
| 2011/0140820 | A1 | 6/2011 | Guentert et al. | |
| 2011/0156853 | A1 * | 6/2011 | Kato | H01F 27/306 336/192 |
| 2011/0241815 | A1 | 10/2011 | Lu | |
| 2012/0139684 | A1 * | 6/2012 | Kobayashi et al. | 336/92 |
| 2012/0194311 | A1 * | 8/2012 | Suzuki | 336/92 |
| 2012/0200382 | A1 | 8/2012 | Hejny | |
| 2013/0106556 | A1 * | 5/2013 | Suzuki et al. | 336/212 |
| 2013/0141201 | A1 | 6/2013 | Chou | |

FOREIGN PATENT DOCUMENTS

| | | | | |
|---|---|---|---|---|
| DE | 202005001931 | U1 | 5/2005 | |
| DE | 102010043595 | A1 | 5/2012 | |
| FR | 2622064 | A | 4/1989 | |
| GB | 740572 | | 11/1955 | |
| JP | 55149430 | A | 11/1980 | |
| JP | 60210817 | A * | 10/1985 | |
| JP | 05217748 | A | 8/1993 | |
| JP | 2003007547 | A | 1/2003 | |
| JP | 2011062061 | A | 3/2011 | |
| JP | 2011122711 | A | 6/2011 | |
| JP | 2012169466 | A | 9/2012 | |
| WO | WO 2011132361 | A1 * | 10/2011 | |
| WO | 2012107826 | A1 | 8/2012 | |
| WO | WO 2012153619 | A1 * | 11/2012 | |
| WO | WO 2013001591 | A1 * | 1/2013 | H01F 37/00 |

OTHER PUBLICATIONS

James, et al., "DC_DC Converter for Hybrid and All Electric Vehicles," EVS24 International Battery, Hybrid and Fuel Cell Electric Vehicle Symposium, Stavanger, Norway (2009) pp. 1-9.

Marz, et al. "Power Electronics System Intergration for Electric and Hybrid Vehicles," Fraunhofer Institute of Integrated Systems and Device Technology, Erlangen Germany, (2010) pp. 1-10.

* cited by examiner

INDUCTOR ASSEMBLY SUPPORT STRUCTURE

TECHNICAL FIELD

One or more embodiments relate to an inductor assembly of a DC-DC converter, and structure for supporting the inductor assembly inside of a transmission housing.

BACKGROUND

The term "electric vehicle" as used herein, includes vehicles having an electric machine for vehicle propulsion, such as battery electric vehicles (BEV), hybrid electric vehicles (HEV), and plug-in hybrid electric vehicles (PHEV). A BEV includes an electric machine, wherein the energy source for the electric machine is a battery that is re-chargeable from an external electric grid. In a BEV, the battery is the source of energy for vehicle propulsion. A HEV includes an internal combustion engine and one or more electric machines, wherein the energy source for the engine is fuel and the energy source for the electric machine is a battery. In a HEV, the engine is the main source of energy for vehicle propulsion with the battery providing supplemental energy for vehicle propulsion (the battery buffers fuel energy and recovers kinematic energy in electric form). A PHEV is like a HEV, but the PHEV has a larger capacity battery that is rechargeable from the external electric grid. In a PHEV, the battery is the main source of energy for vehicle propulsion until the battery depletes to a low energy level, at which time the PHEV operates like a HEV for vehicle propulsion.

Electric vehicles may include a voltage converter (DC-DC converter) connected between the battery and the electric machine. Electric vehicles that have AC electric machines also include an inverter connected between the DC-DC converter and each electric machine. A voltage converter increases ("boosts") or decreases ("bucks") the voltage potential to facilitate torque capability optimization. The DC-DC converter includes an inductor (or reactor) assembly, switches and diodes. A typical inductor assembly includes a conductive coil that is wound around a magnetic core. The inductor assembly generates heat as current flows through the coil. An existing method for cooling the DC-DC converter by circulating fluid through a conduit that is proximate to the inductor is disclosed in U.S. 2004/0045749 to Jaura et al.

SUMMARY

In one embodiment, a vehicle is provided with a transmission and an inductor assembly that is mounted within a chamber of the transmission. The inductor assembly includes an insulator having first and second portions that are oriented toward each other. Each portion includes a base, a support extending from the base, and a spool extending transversely from the support to engage the other portion. Each spool includes an external surface for supporting a coil and a cavity extending therethrough for receiving a core.

In another embodiment, an inductor assembly is provided with a coil, a core, and an insulator that mounted within a transmission chamber. The insulator includes first and second portions oriented toward each other. Each portion includes a base, a support extending from the base, and a spool extending transversely from the support to engage the spool of the other portion. Each spool includes an external surface for supporting the coil and a cavity extending therethrough for receiving the core.

In yet another embodiment, a transmission that defines a chamber is provided. The transmission includes an inductor assembly that is mounted within the chamber. The inductor assembly includes an insulator having first and second portions that are oriented toward each other. Each portion includes a base, a support extending from the base, and a spool extending transversely from the support to engage the other portion. Each spool includes an external surface for supporting a coil and a cavity extending therethrough for receiving a core.

As such, the transmission and the inductor assembly provide advantages over existing systems, by providing structure to support the coil and the core while facilitating direct cooling of the coil and the core using transmission fluid.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
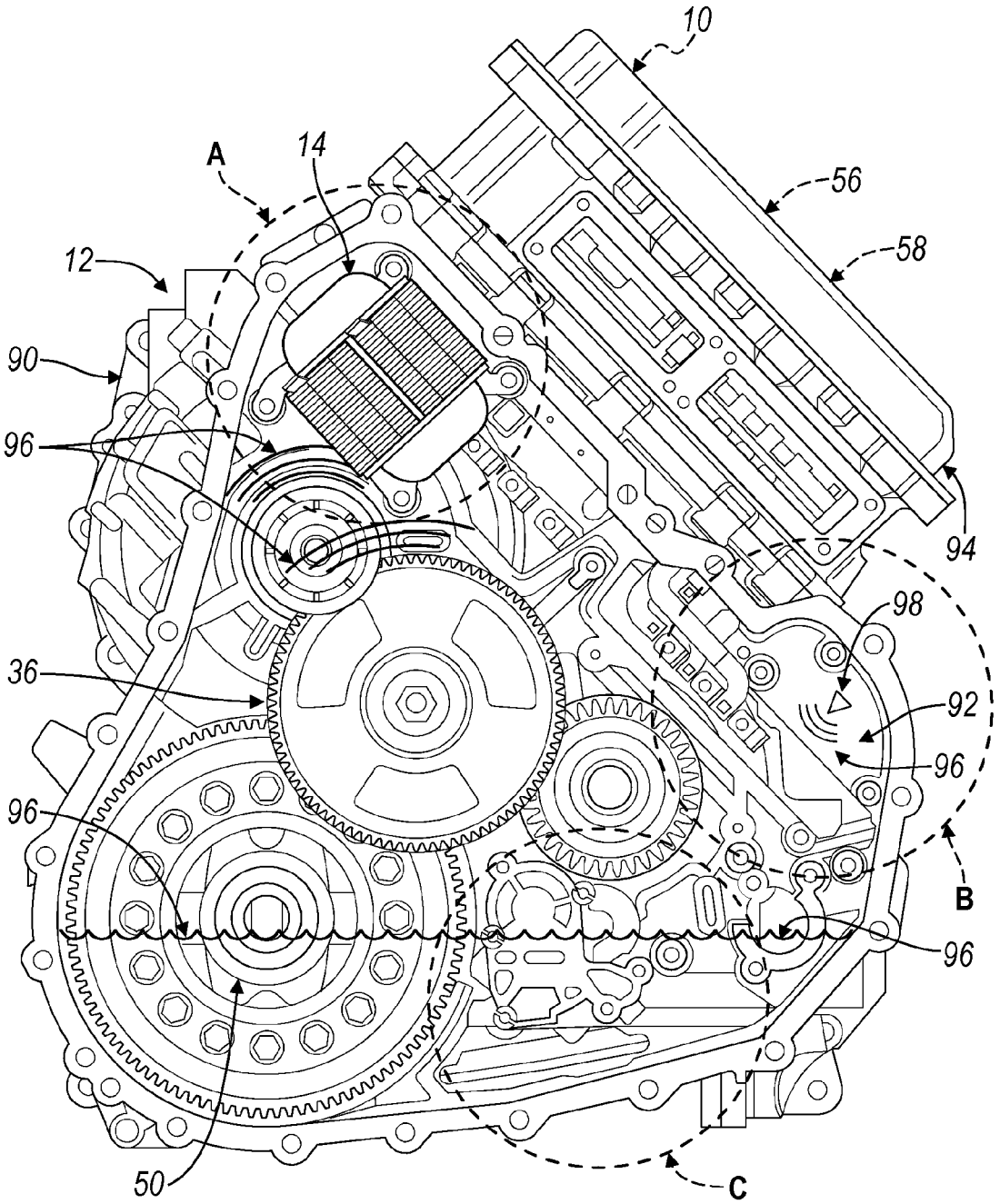
FIG. 1 is a front view of a transmission and a variable voltage converter (VVC) having an inductor assembly, and illustrating structure for supporting the inductor assembly within the transmission according to one or more embodiments.

With reference to FIG. 1, a DC-DC converter is illustrated in accordance with one or more embodiments and is generally referenced by numeral 10. The DC-DC converter 10 may also be referred to as a variable voltage converter (VVC) 10. The VVC 10 is an assembly with components that are mounted both inside and outside of a transmission 12. The VVC 10 includes an inductor assembly 14 having exposed surface area that is mounted inside of the transmission 12. The VVC 10 also includes a number of switches and diodes (shown in FIG. 3) that are mounted outside of the transmission 12 and are operably coupled to the inductor assembly 14. By mounting the inductor assembly 14 within the transmission 12, the exposed surface area of the inductor assembly 14 may be directly cooled by transmission fluid which allows for improved thermal performance. The transmission 12 includes additional structure for supporting the inductor assembly 14 while allowing the transmission fluid to flow through the structure to contact the exposed surface area.

Figure 2:
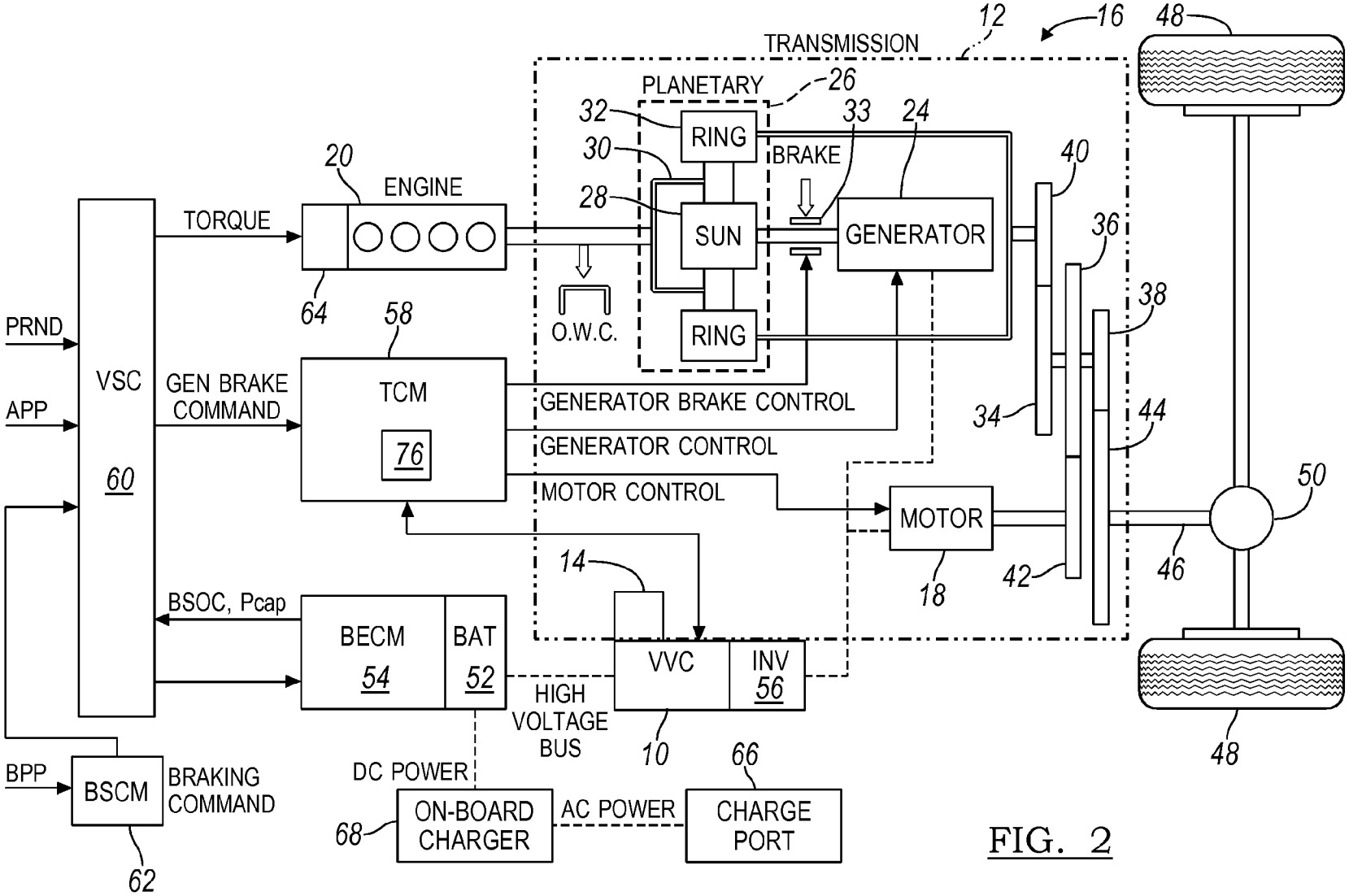
FIG. 2 is a schematic diagram of a vehicle including the transmission and the VVC of FIG. 1.

Referring to FIG. 2, the transmission 12 is depicted within a plug-in hybrid electric vehicle (PHEV) 16, which is an electric vehicle propelled by an electric machine 18 with assistance from an internal combustion engine 20 and connectable to an external power grid. The electric machine 18 is an AC electric motor according to one or more embodiments, and depicted as the "motor" 18 in FIG. 1. The electric machine 18 receives electrical power and provides drive torque for vehicle propulsion. The electric machine 18 also functions as a generator for converting mechanical power into electrical power through regenerative braking.

The transmission 12 has a power-split configuration, according to one or more embodiments. The transmission 12 includes the first electric machine 18 and a second electric machine 24. The second electric machine 24 is an AC electric motor according to one or more embodiments, and depicted as the "generator" 24 in FIG. 1. Like the first electric machine 18, the second electric machine 24 receives electrical power and provides output torque. The second electric machine 24 also functions as a generator for converting mechanical power into electrical power and optimizing power flow through the transmission 12.

The transmission 12 includes a planetary gear unit 26, which includes a sun gear 28, a planet carrier 30 and a ring gear 32. The sun gear 28 is connected to an output shaft of the second electric machine 24 for receiving generator torque. The planet carrier 30 is connected to an output shaft of the engine 20 for receiving engine torque. The planetary gear unit 26 combines the generator torque and the engine torque and provides a combined output torque about the ring gear 32. The planetary gear unit 26 functions as a continuously variable transmission, without any fixed or "step" ratios.

The transmission 12 also includes a one-way clutch (O.W.C.) and a generator brake 33, according to one or more embodiments. The O.W.C. is coupled to the output shaft of the engine 20 to only allow the output shaft to rotate in one direction. The O.W.C. prevents the transmission 12 from back-driving the engine 20. The generator brake 33 is coupled to the output shaft of the second electric machine 24. The generator brake 33 may be activated to "brake" or prevent rotation of the output shaft of the second electric machine 24 and of the sun gear 28. In other embodiments, the O.W.C. and the generator brake 33 are eliminated, and replaced by control strategies for the engine 20 and the second electric machine 24.

The transmission 12 includes a countershaft having intermediate gears including a first gear 34, a second gear 36 and a third gear 38. A planetary output gear 40 is connected to the ring gear 32. The planetary output gear 40 meshes with the first gear 34 for transferring torque between the planetary gear unit 26 and the countershaft. An output gear 42 is connected to an output shaft of the first electric machine 18. The output gear 42 meshes with the second gear 36 for transferring torque between the first electric machine 18 and the countershaft. A transmission output gear 44 is connected to a driveshaft 46. The driveshaft 46 is coupled to a pair of driven wheels 48 through a differential 50. The transmission output gear 44 meshes with the third gear 38 for transferring torque between the transmission 12 and the driven wheels 48.

The vehicle 16 includes an energy storage device, such as a battery 52 for storing electrical energy. The battery 52 is a high voltage battery that is capable of outputting electrical power to operate the first electric machine 18 and the second electric machine 24. The battery 52 also receives electrical power from the first electric machine 18 and the second electric machine 24 when they are operating as generators. The battery 52 is a battery pack made up of several battery modules (not shown), where each battery module contains a plurality of battery cells (not shown). Other embodiments of the vehicle 16 contemplate different types of energy storage devices, such as capacitors and fuel cells (not shown) that supplement or replace the battery 52. A high voltage bus electrically connects the battery 52 to the first electric machine 18 and to the second electric machine 24.

The vehicle includes a battery energy control module (BECM) 54 for controlling the battery 52. The BECM 54 receives input that is indicative of vehicle conditions and battery conditions, such as battery temperature, voltage and current. The BECM 54 calculates and estimates battery parameters, such as battery state of charge and the battery power capability. The BECM 54 provides output (BSOC, $P_{cap}$) that is indicative of a battery state of charge (BSOC) and a battery power capability to other vehicle systems and controllers.

The transmission 12 includes the VVC 10 and an inverter 56. The VVC 10 and the inverter 56 are electrically connected between the main battery 52 and the first electric machine 18; and between the battery 52 and the second electric machine 24. The VVC 10 "boosts" or increases the voltage potential of the electrical power provided by the battery 52. The VVC 10 also "bucks" or decreases the voltage potential of the electrical power provided by the battery 52, according to one or more embodiments. The inverter 56 inverts the DC power supplied by the main battery 52 (through the VVC 10) to AC power for operating the electric machines 18, 24. The inverter 56 also rectifies AC power provided by the electric machines 18, 24, to DC for charging the main battery 52. Other embodiments of the transmission 12 include multiple inverters (not shown), such as one inverter associated with each electric machine 18, 24.

The transmission 12 includes a transmission control module (TCM) 58 for controlling the electric machines 18, 24, the VVC 10 and the inverter 56. The TCM 58 is configured to monitor, among other things, the position, speed, and power consumption of the electric machines 18, 24. The TCM 58 also monitors electrical parameters (e.g., voltage and current) at various locations within the VVC 10 and the inverter 56. The TCM 58 provides output signals corresponding to this information to other vehicle systems.

The vehicle 16 includes a vehicle system controller (VSC) 60 that communicates with other vehicle systems and controllers for coordinating their function. Although it is shown as a single controller, the VSC 60 may include multiple controllers that may be used to control multiple vehicle systems according to an overall vehicle control logic, or software.

The vehicle controllers, including the VSC 60 and the TCM 58 generally includes any number of microprocessors, ASICs, ICs, memory (e.g., FLASH, ROM, RAM, EPROM and/or EEPROM) and software code to co-act with one another to perform a series of operations. The controllers also include predetermined data, or "look up tables" that are based on calculations and test data and stored within the memory. The VSC 60 communicates with other vehicle systems and controllers (e.g., the BECM 54 and the TCM 58) over one or more wired or wireless vehicle connections using common bus protocols (e.g., CAN and LIN). The VSC 60 receives input (PRND) that represents a current position of the transmission 12 (e.g., park, reverse, neutral or drive). The VSC 60 also receives input (APP) that represents an accelerator pedal position. The VSC 60 provides output that represents a desired wheel torque, desired engine speed, and generator brake command to the TCM 58; and contactor control to the BECM 54.

The vehicle 16 includes a braking system (not shown) which includes a brake pedal, a booster, a master cylinder, as well as mechanical connections to the driven wheels 48, to effect friction braking. The braking system also includes position sensors, pressure sensors, or some combination thereof for providing information such as brake pedal position (BPP) that corresponds to a driver request for brake torque. The braking system also includes a brake system control module (BSCM) 62 that communicates with the VSC 60 to coordinate regenerative braking and friction braking. The BSCM 62 provides a regenerative braking command to the VSC 60, according to one embodiment.

The vehicle 16 includes an engine control module (ECM) 64 for controlling the engine 20. The VSC 60 provides output (desired engine torque) to the ECM 64 that is based on a number of input signals including APP, and corresponds to a driver's request for vehicle propulsion.

The vehicle 16 is configured as a plug-in hybrid electric vehicle (PHEV) according to one or more embodiments. The battery 52 periodically receives AC energy from an external power supply or grid, via a charge port 66. The vehicle 16 also includes an on-board charger 68, which receives the AC energy from the charge port 66. The charger 68 is an AC/DC converter which converts the received AC energy into DC energy suitable for charging the battery 52. In turn, the charger 68 supplies the DC energy to the battery 52 during recharging.

Although illustrated and described in the context of a PHEV 16, it is understood that embodiments of the VVC 10 may be implemented on other types of electric vehicles, such as a HEV or a BEV.

Figure 3:
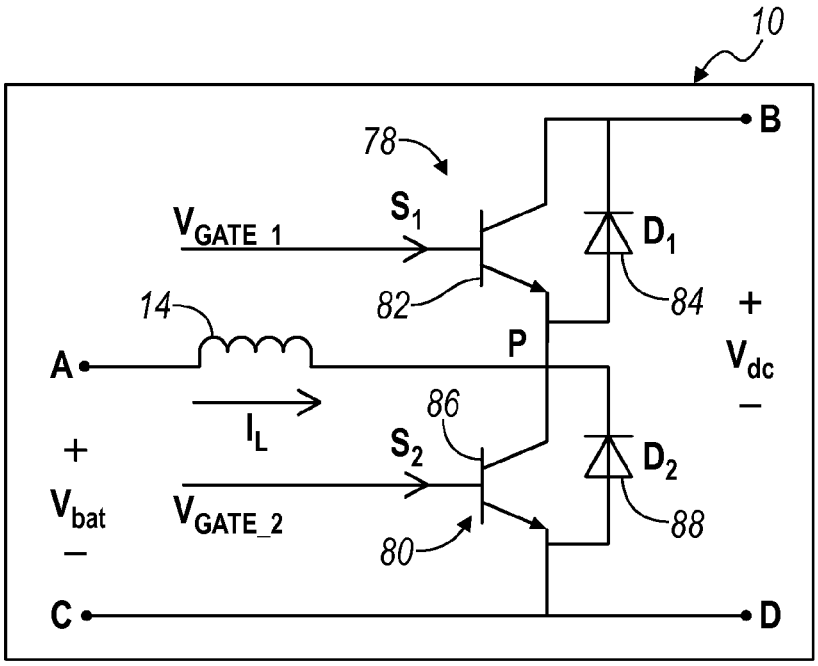
FIG. 3 is a circuit diagram of the VVC of FIG. 1.

With reference to FIG. 3, the VVC 10 includes a first switching unit 78 and a second switching unit 80 for boosting the input voltage ($V_{bat}$) to provide output voltage ($V_{dc}$). The first switching unit 78 includes a first transistor 82 connected in parallel to a first diode 84, but with their polarities switched (anti-parallel). The second switching unit 80 includes a second transistor 86 connected anti-parallel to a second diode 88. Each transistor 82, 86 may be any type of controllable switch (e.g., an insulated gate bipolar transistor (IGBT) or field-effect transistor (FET)). Additionally, each transistor 82, 86 is individually controlled by the TCM 58. The inductor assembly 14 is depicted as an input inductor that is connected in series between the main battery 52 and the switching units 78, 80. The inductor 14 generates magnetic flux when a current is supplied. When the current flowing through the inductor 14 changes, a time-varying magnetic field is created, and a voltage is induced. Other embodiments of the VVC 10 include different circuit configurations (e.g., more than two switches).

Referring back to FIG. 1, the transmission 12 includes a transmission housing 90, which is illustrated without a cover to show internal components. As described above, the engine 20, the motor 18 and the generator 24 include output gears that mesh with corresponding gears of the planetary gear unit 26. These mechanical connections occur within an internal chamber 92 of the transmission housing 90. A power electronics housing 94 is mounted to an external surface of the transmission 12. The inverter 56 and the TCM 58 are mounted within the power electronics housing 94. The VVC 10 includes components (e.g., the switches 78, 80 and diodes 84, 88 shown in FIG. 3) that are mounted within the power electronics housing 94 and the inductor assembly 14 which is mounted within the chamber 92 of the transmission housing 90.

The transmission 12 includes fluid 96 such as oil, for lubricating and cooling the gears located within the transmission chamber 92 (e.g., the intermediate gears 34, 36, 38). The transmission chamber 92 is sealed to retain the fluid 96. The transmission 12 also includes pumps and conduits (not shown) for circulating the fluid 96 through the chamber 92.

Rotating elements (e.g., gears and shafts) may displace or "splash" fluid 96 on other components. Such a "splash" region is referenced by letter "A" in FIG. 1 and is located in an upper portion of the chamber 92. In region A, the inductor assembly 14 is cooled by transmission fluid 96 that splashes off of the rotating elements (e.g., the second intermediate gear 36 and the differential 50) as they rotate.

The transmission 12 includes nozzles 98 for directly spraying the transmission fluid 96 on components within the housing 90, according to one or more embodiments. Such a "spray" region is referenced by letter "B" in FIG. 1 and is located in an intermediate portion of the chamber 92. The inductor assembly 14 may be mounted within region B and cooled by transmission fluid 96 that sprays from the nozzle 98. The inductor assembly 14 may also receive transmission fluid 96 that splashes off of proximate rotating elements (e.g., the planetary gear unit 26). Other embodiments of the transmission 12 contemplate multiple nozzles (nozzles) one or more nozzles that are mounted in other locations of the chamber 92 (e.g., a nozzle mounted in region A).

Further, the transmission fluid 96 accumulates within a lower portion of the chamber 92. Such an "immersion" region is referenced by letter "C" in FIG. 1 and is located in a lower portion of the chamber 92. The inductor assembly 14 may be mounted within region C and immersed in the transmission fluid 96.

Figure 4:
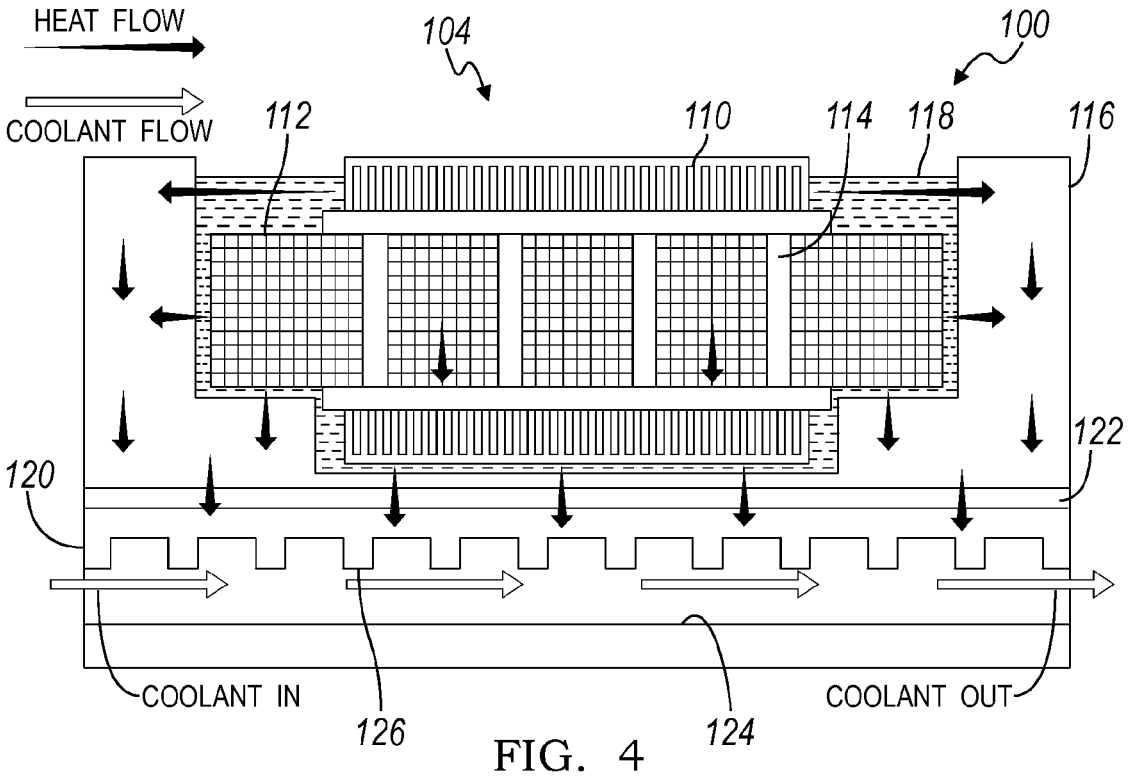
FIG. 4 is a section view of structure for supporting an inductor assembly according to another embodiment.

FIG. 4 illustrates structure 100 for supporting a potted inductor assembly 104 that is configured for indirect cooling according to an existing method. Such an inductor assembly 104 is mounted external of the transmission housing 90 (e.g., within the power electronics housing 94 of FIG. 1). The inductor assembly 104 includes a conductor 110 that is wrapped around a magnetic core 112. The magnetic core 112 includes a plurality of core elements that are spaced apart to define air gaps 114. Ceramic spacers may be placed between the core elements to maintain the air gaps 114. The structure 100 includes an inductor housing 116 and a potting compound 118. The inductor assembly 104 is encased inside the inductor housing 116 (e.g., an Aluminum housing) and empty space around the inductor assembly 104 is filled with a thermally conductive, electrically insulating adhesive material, such as the potting compound 118. The inductor housing 116 is clamped to a cold plate 120 and thermal grease 122 is applied between the inductor housing 116 and the cold plate 120. A passage 124 is formed through the cold plate 120. Cold fluid or coolant (e.g., 50% water and 50% ethylene glycol) flows through the passage 124. Heat transfers by conduction from the conductor 110 and the core 112 to the potting compound 118 and then to housing 116, thermal grease 122 and finally into the cold plate 120. Heat from the cold plate 120 transfers into the coolant flowing through the passage 124 by convection. Additionally the cold plate 120 may include fins 126 for transferring heat into surrounding fluid by convection.

The thermal resistance of the heat transfer path from the conductor 110 to the coolant flowing through the passage 124 of the cold plate 120 is high. The thermal grease 122, the potting compound 118 and the cold plate 120 contribute significantly to this resistance. As a result, the thermal performance of this potted inductor assembly 104 is limited, and the temperature of the inductor assembly 104 at various locations increases may exceed predetermined temperature limits at high electrical power loads. In one or more embodiments, a controller (e.g., the TCM of FIG. 1) may limit the performance of the inductor assembly 104 if temperatures of the inductor assembly 104 exceed such predetermined limits.

The temperature of the inductor assembly 104 depends on the amount of current flowing through the conductor 110 and the voltage potential across the conductor 110. Recent trends in electric vehicles include higher current capability of the inductor. For example, increased battery power for the extended electric range in PHEVs and reduced battery cells for the same power in HEVs result in increased inductor current rating in electric vehicles. Additionally, reduced battery voltage also leads to an increase in the inductor AC losses due to a higher magnitude of high frequency ripple current. Therefore, due to additional heat generation, the temperature of the inductor assembly 104 will generally increase and if heat is not dissipated, the inductor temperature may exceed predetermined limits. One solution is to increase the cross-sectional area of the conductor coil to reduce inductor loss and also improve heat dissipation (due to more surface area). However, such changes will increase the overall size of the inductor assembly. A larger inductor assembly may be difficult to package in all vehicle applications, and larger components affect vehicle fuel economy and cost.

Rather than increase the size of the inductor assembly 104, to improve the inductor thermal performance and thermal capacity, the inductor assembly 104 may be mounted within the transmission chamber 92 and directly cooled using transmission fluid 96 as described with reference to FIG. 1. The transmission fluid 96 is an electrical insulator which can be used in direct contact with electrical components (e.g., the conductor 110 and the core 112). However, excess components associated with the inductor assembly 104 may be removed if the assembly 104 is subjected to such direct cooling. For example, the potting compound 118 and the aluminum housing 116 may be removed. However, the potting compound 118 and the housing 116 support the conductor 110 and the core 112. Additionally, vibration is more severe inside of the transmission 12, than outside. Therefore the overall structure of the inductor assembly 104 is revised in order to remove or reduce the potting compound 118 and the housing 116 and to mount the assembly inside of the transmission 12.

Figure 5:
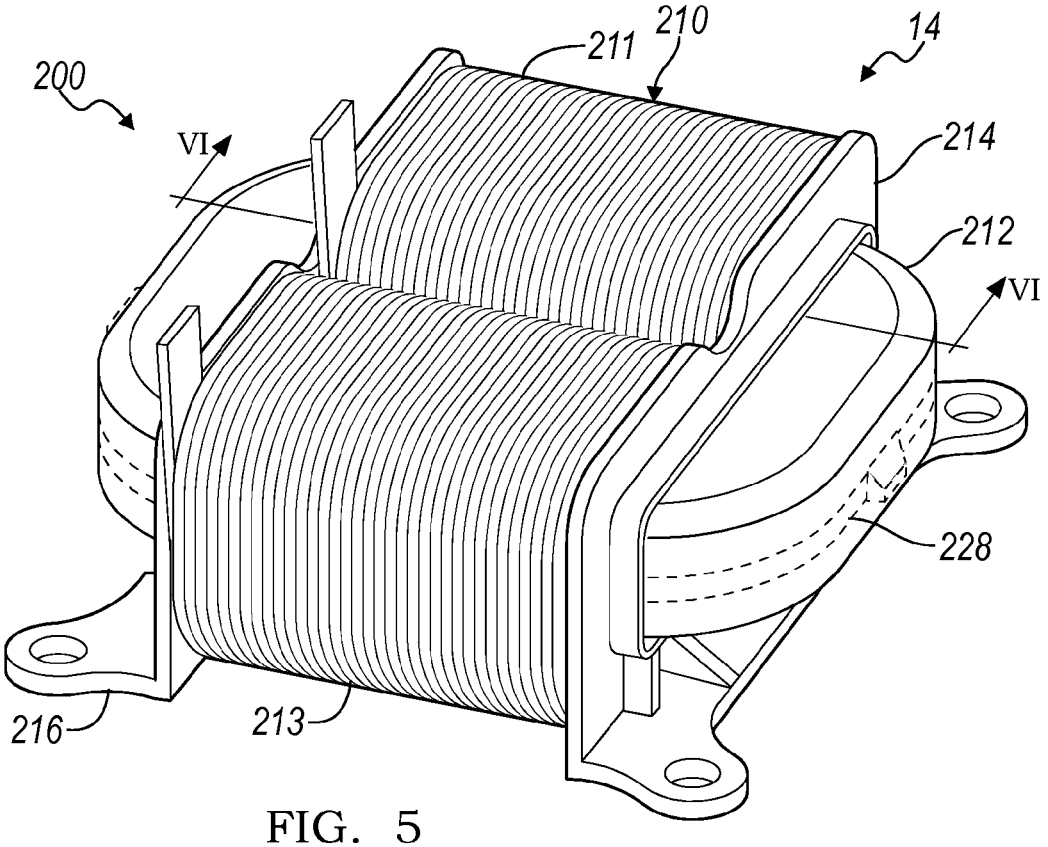
FIG. 5 is an enlarged front perspective view of an inductor assembly including support structure according to one or more embodiments.

FIG. 5 illustrates structure for supporting the inductor assembly 14 within the transmission 12 according to one or more embodiments, and is generally referenced by numeral 200. The inductor assembly 14 provides a simplified version of the inductor assembly 104 described with reference to FIG. 4, in that the excess components (e.g., the potting compound, the aluminum housing, the cold plate and the thermal grease) have been removed. The inductor assembly 14 includes a conductor 210 that is formed into two adjacent tubular coils, a core 212 and an insulator 214. The structure 200 includes the insulator 214, which is formed as a two-piece bracket and supports the conductor 210 and the core 212. Additionally, the insulator 214 physically separates the conductor 210 from the core 212 and is formed of an electrically insulating polymeric material, such as Polyphenylene sulfide (PPS).

Figure 6:
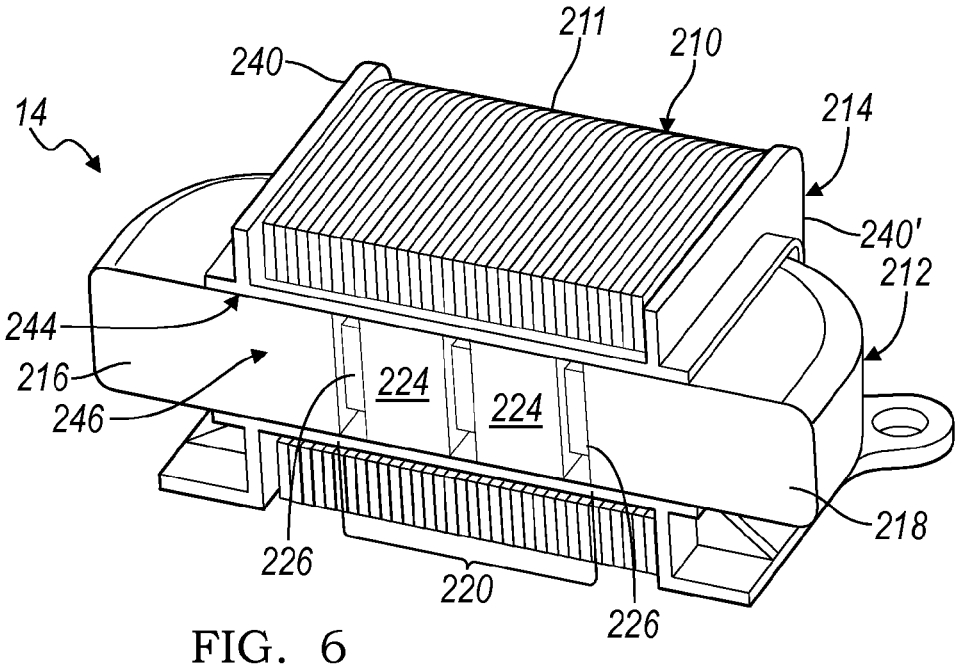
FIG. 6 is a section view of the inductor assembly of FIG. 5 taken along section line VI-VI.
Figure 7:
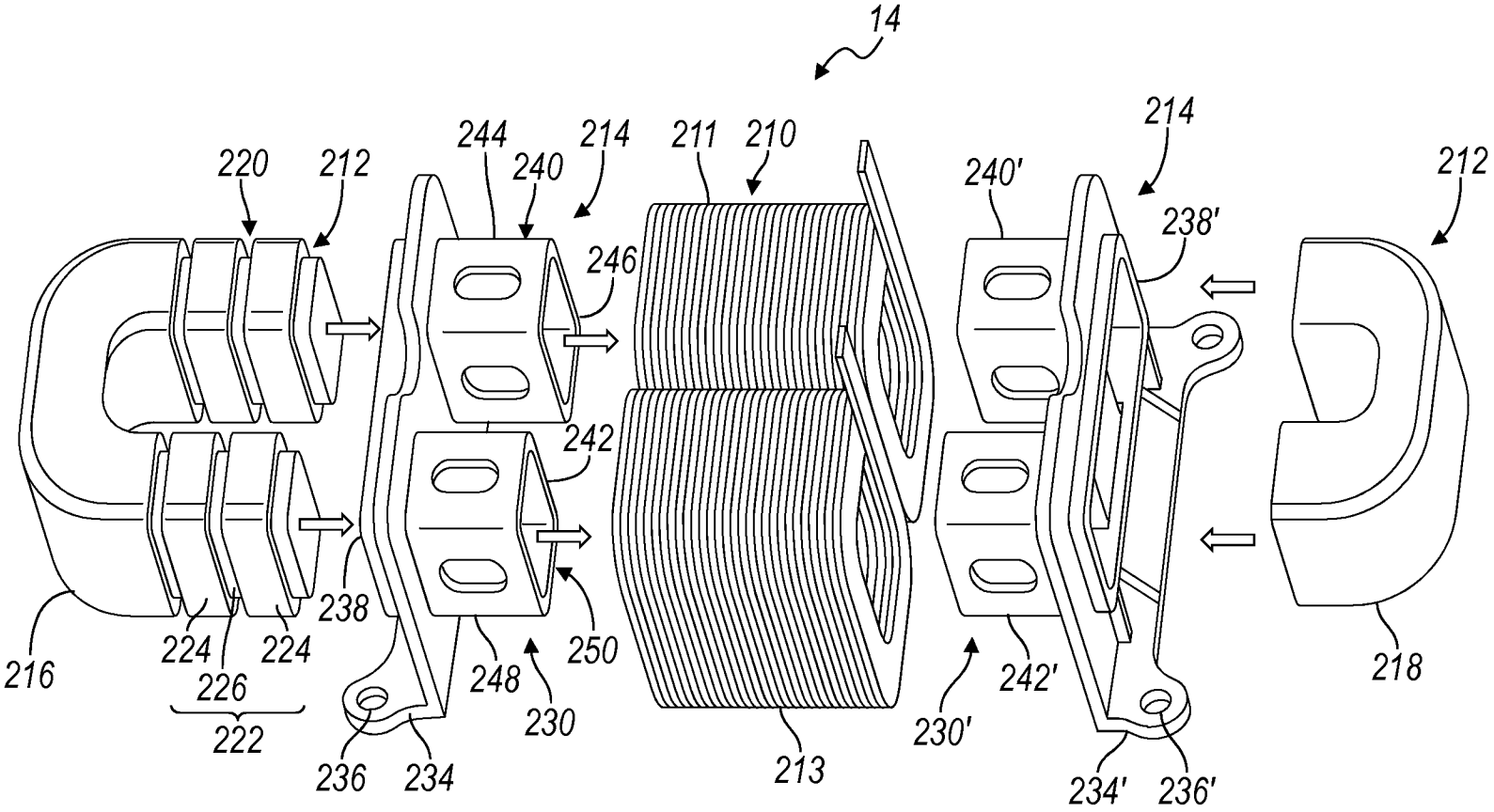
FIG. 7 is an exploded view of the inductor assembly of FIG. 5.

Referring to FIGS. 5-7, the conductor 210 is formed of a conductive material, such as copper or aluminum, and wound into two adjacent helical coils, a first coil 211 and a second coil 213. The coils are formed using a rectangular (or flat) type conductive wire by an edgewise process, according to one or more embodiments. An input and output lead extend from the conductor 210 and connect to components that are mounted external to the transmission 12 (e.g., the battery 52 and the switches 78, 80 as shown in FIGS. 2 and 3).

The core 212 is formed in a dual "C" configuration, according to the illustrated embodiment. The core 212 includes a first end 216, a second end 218 that are each formed in a curved shape. The core 212 also includes a first leg 220 and a second leg 222 for interconnecting the first end 216 to the second end 218 to collectively form a ring shaped core 212. Each leg 220, 222 includes a plurality of core elements 224 that are spaced apart to define air gaps. (FIG. 6). The core 212 is formed of a magnetic material, such as an iron silicon alloy powder, according to one embodiment. Ceramic spacers 226 may be placed between the core elements 224 to maintain the air gaps. An adhesive may be applied to the core 212 to maintain the position of the ends 216, 218 and the legs 220, 222 including the core elements 224 and the spacers 226. In other embodiments, a strap 228, as shown in phantom view in FIG. 5, is secured about an outer circumference of the core 212 to maintain the position of the ends 216, 218 and legs 220, 222.

Referring to FIG. 7, the insulator 214 is formed as a bobbin structure with a first half portion 230 and a second half portion 230' that are generally symmetrical to each other. Each half portion 230, 230' includes a base 234, 234' for resting upon a transmission wall (FIG. 1). The base 234, 234' includes apertures 236, 236' for receiving fasteners (not shown) for mounting the inductor assembly 14 to the transmission, according to one or more embodiments. A support 238, 238' extends transversely from the base 234, 234'. A pair of spools, including a first spool 240, and a second spool 242, extend from the support 238 of the first half portion 230, to engage a corresponding first spool 240' and second spool 242' that extend from the support 238' of the second half portion 230'. In one embodiment, the first spools 240, 240' are coaxially aligned along a first longitudinal axis (not shown), and the second spools 242, 242' are coaxially aligned along a second longitudinal axis (not shown) that is parallel to the first longitudinal axis. The spools 240, 240', 242, 242' are each formed in a tubular shape with a generally square shaped cross section.

As shown in FIG. 6, the insulator 214 supports the coil 210 and the core 212. The first spools 240, 240' engage each other to collectively provide an external surface 244 for supporting the first coil 211. The first spools 240, 240' also define a cavity 246 for receiving the first leg 220 of the core 212. Similarly, the second spools 242, 242' engage each other to collectively provide an external surface 248 for supporting the second coil 213, and define a cavity 250 for receiving the second leg 222 of the core 212 (shown in FIG. 7). According to the illustrated embodiment, the spools 240, 240', 242, 242' include a plurality of holes 252 for facilitating heat transfer from the legs 220, 222 by allowing the transmission fluid to easily pass through the spools 240, 240', 242, 242'. Other embodiments of the insulator 214 include nonsymmetrical half portions (not shown). For example, in one embodiment of the insulator 214, the spools extend from one of the half portions and are received by the support of the other half portion (not shown).

FIG. 7 illustrates a method for assembling the inductor assembly 14 according to one or more embodiments. The conductor 210 is formed into first and second coils 211, 213 using an edgewise process. The half portions 230, 230' are then translated toward each other such that the first spools 240, 240' are each inserted into the cavity of the first coil 211 in opposing directions, and the second spools 242, 242' are each inserted into the cavity of the second coil 213 in opposing directions.

The core 212 is assembled by first assembling the first and second legs 220, 222 which includes attaching the core elements 224 and ceramic spacers 226 together using an adhesive or laminate. The first end 216 of the core 212 is then attached to the legs 220, 222. A core 212 sub-assembly, including the first end 216 and the legs 220, 222 is translated toward the conductor 210 and insulator 214, such that the legs 220, 222 are inserted into the corresponding first and second spools 240, 240', 242, 242'. The second end 218 of the core 212 is then attached to a distal end of each leg 220, 222 using an adhesive or laminate. In one or more embodiments, a strap 228 (shown in FIG. 5) is wrapped around the core 212 to maintain the connection and orientation of the various core components. In the illustrated embodiment, the insulator 214 provides the structure 200 for supporting the conductor 210 and the core 212; and the base 234, 234' is configured to be mounted to a wall of the transmission (as shown in FIG. 1). However, the inductor assembly 204 may be subjected to high vibration within the transmission, depending on where it is mounted (e.g., Regions A, B, or C). Therefore in other embodiments, the transmission includes additional structure for supporting and mounting the inductor assembly 204 within the transmission, as will be described below with reference to FIGS. 8-18.

Figure 8:
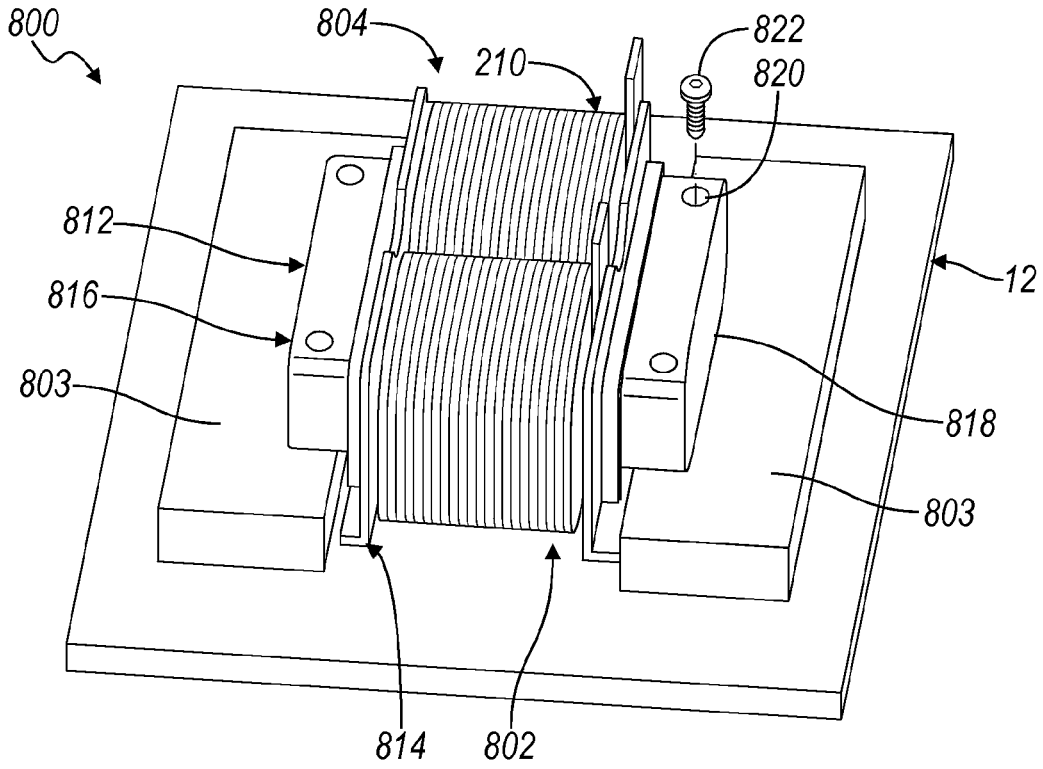
FIG. 8 is a front perspective view of a portion of the transmission and structure for supporting an inductor assembly according to another embodiment.

With reference to FIG. 8, a structure for supporting an inductor assembly within the transmission 12 is illustrated in accordance with one or more embodiments and is generally referenced by numeral 800. The structure 800 includes a recess 802 that is formed into a wall 803 of the transmission 12. An inductor assembly 804 is supported by the structure 800. The inductor assembly 804 includes the conductor 210, as described above with reference to FIGS. 5-7, along with a core 812 and an insulator 814.

The core 812 is similar to the core 212 described above with reference to FIGS. 5-7, however the core 812 includes a first end 816 and a second end 818 having apertures 820 formed therethrough for receiving fasteners 822. Each fastener 822 is inserted through a corresponding aperture 820 to engage a threaded hole (not shown) formed in the wall 803 of the transmission about the recess 802, for mounting the inductor assembly 804 to the transmission 12.

The conductor 210 and the insulator 814 are disposed within the recess 802. The insulator 814 is similar to the insulator 214 described above with reference to FIGS. 5-7, however the insulator 814 includes a base 824 without any mounting apertures.

As described above, the insulator 814 is formed of an electrically insulating polymeric material, such as PPS and physically separates the electrically conductive conductor 210 from the core 812. The transmission 12 is formed a electrically conductive material, such as an aluminum. To avoid any electrical losses due to mounting the core 812 to the transmission 12, an electrically insulative material (not shown) may be disposed between each of the first end 816 and the second end 818 and the transmission 12.

Figure 9:
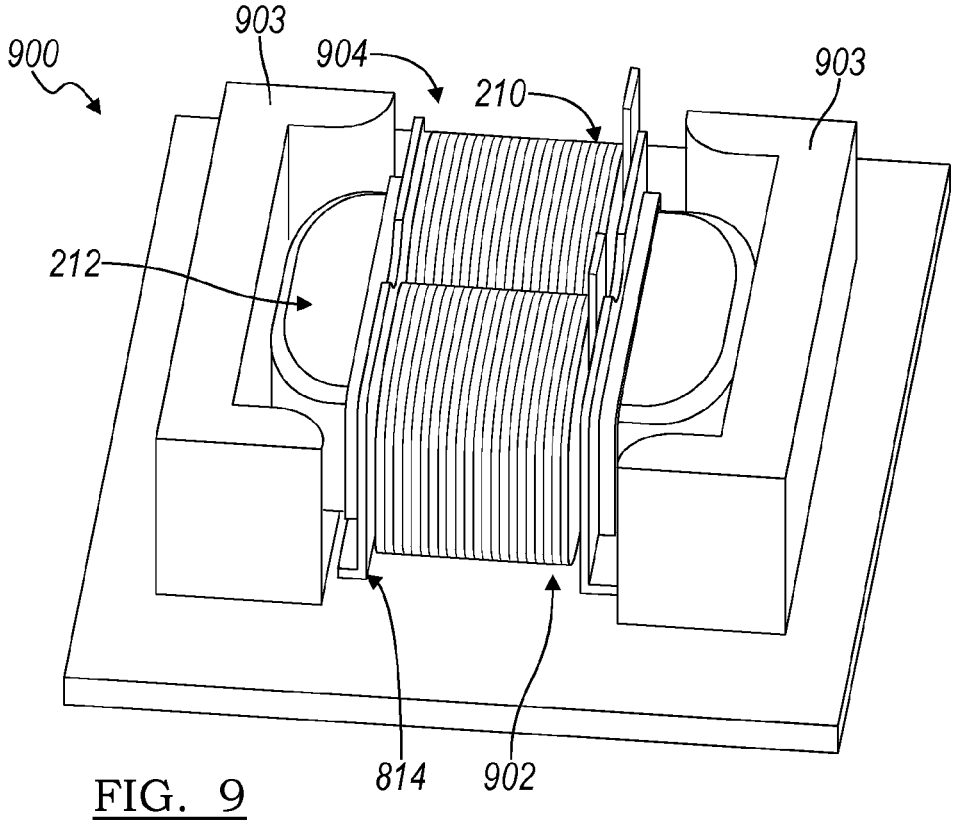
FIG. 9 is a front perspective view of a portion of the transmission and structure for supporting an inductor assembly according to another embodiment.

Referring to FIG. 9, a structure for supporting an inductor assembly within the transmission 12 is illustrated in accordance with one or more embodiments and is generally referenced by numeral 900. The structure 900 includes a recess 902 that is formed into a wall 903 of the transmission 12. An inductor assembly 904 is supported by the structure 900. The inductor assembly 904 includes the conductor 210, the core 212 and the insulator 814, as described above with reference to the embodiments illustrated in FIGS. 5-8.

The inductor assembly 904 is sized to engage the wall 903 within the recess 902 for both maintaining the core 212 in a ring shape, and for mounting the inductor assembly 904 to the transmission. The inductor assembly 904 is sized such that a longitudinal length of the core 212 corresponds to a longitudinal length of the recess 902 to provide an interference fit, or minimal clearance. However, the costs associated with manufacturing the inductor assembly 904 and the structure 900 at such dimensions may make such a design cost-prohibitive.

Figure 10:
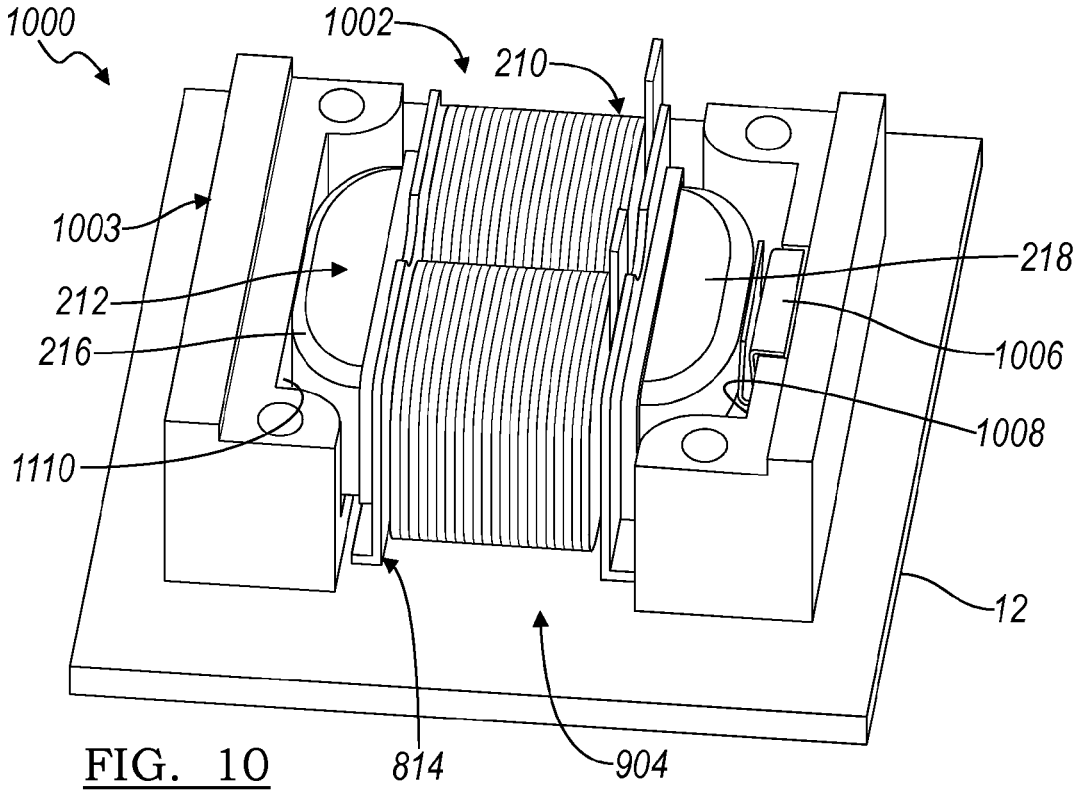
FIG. 10 is a front perspective view of a portion of the transmission and structure for supporting the inductor assembly of FIG. 9 according to another embodiment.
Figure 11:
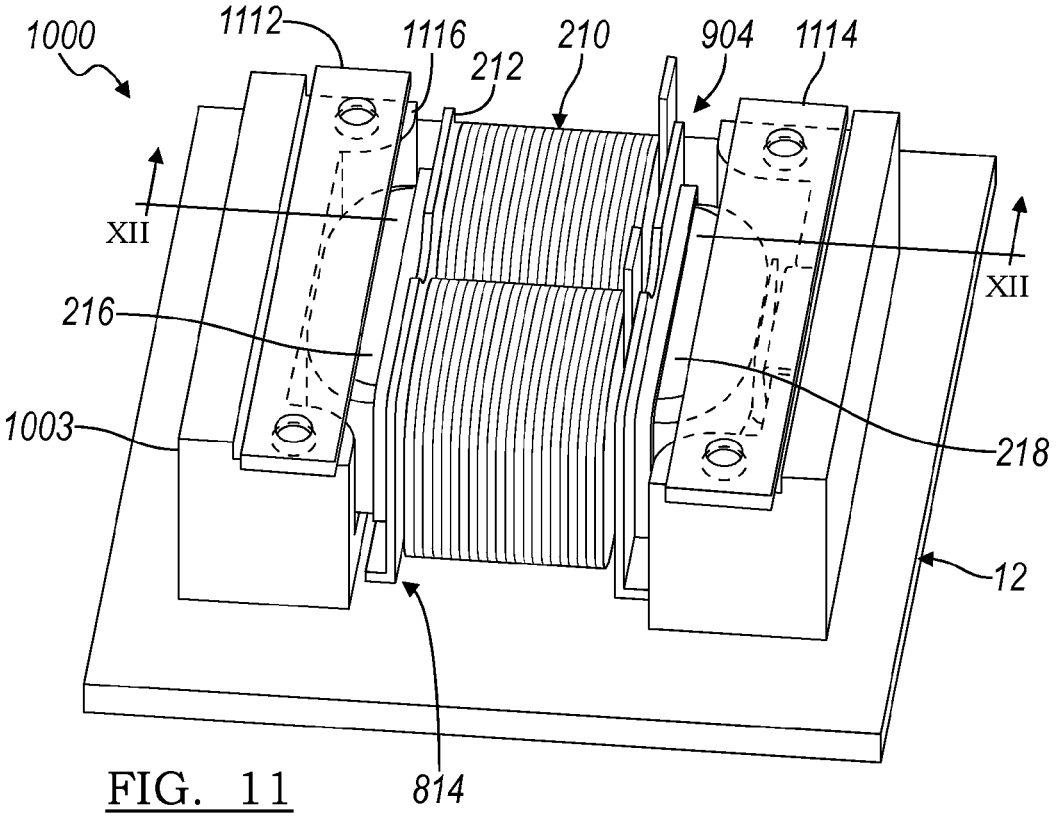
FIG. 11 is another front perspective view of the structure of FIG. 10 for supporting the inductor assembly of FIG. 9.
Figure 12:
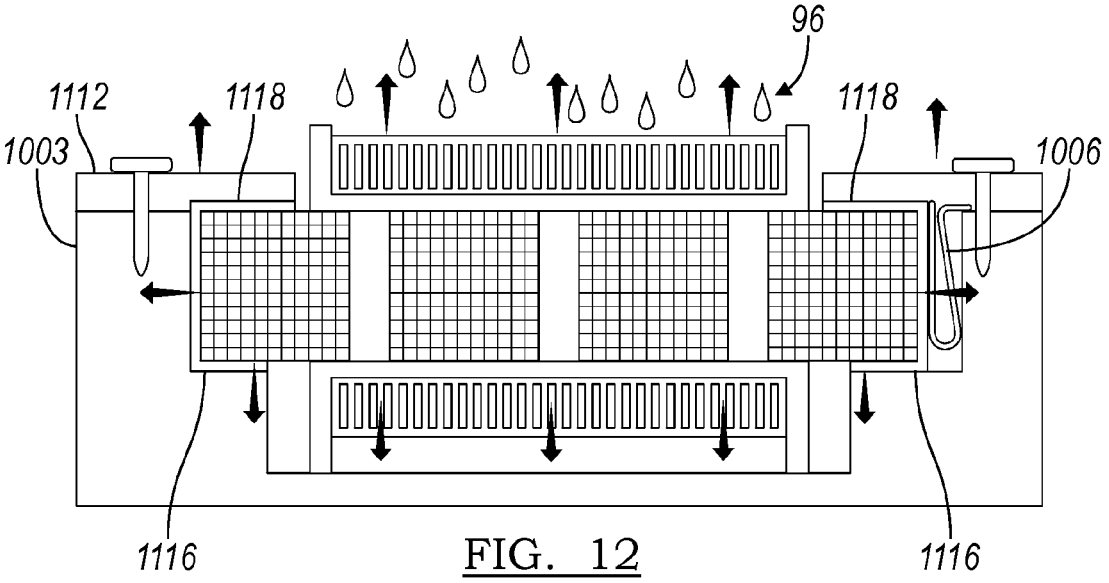
FIG. 12 is a section view of the structure and inductor assembly of FIG. 11 taken along section line XII-XII.

With reference to FIGS. 10-12, a structure for supporting an inductor assembly within the transmission 12 is illustrated in accordance with one or more embodiments and is generally referenced by numeral 1000. The structure 1000 includes a recess 1002 that is formed into a wall 1003 of the transmission 12. The inductor assembly 904 as described above with reference to FIG. 9, including the conductor 210, the core 212 and the insulator 814, is supported by the structure 1000.

The structure 1000 also includes a spring, such as a spring clip 1006, that is mounted to a first inner surface 1008 of the wall 1003. The inductor assembly 904 is sized such that the second end 218 of the core engages the spring clip 1006. The spring clip 1006 imparts a longitudinal force upon the core 212 such that the first end 216 of the core engages a second inner surface 1110 of the wall 1003, for both maintaining the core 212 in a ring shape, and for mounting the inductor assembly 904 to the transmission. The spring clip 1006 elastically deforms in the longitudinal direction to compensate for tolerance variations in the longitudinal length of the core 212, which reduces the costs associated with manufacturing the inductor assembly 904 and the structure 1000 as compared to the structure 900 illustrated in FIG. 9.

Referring to FIG. 11, the structure 1000 includes a first plate 1112 and a second plate 1114 for retaining the inductor assembly 904 within the recess 1002, according to one or more embodiments. The plates 1112, 1114 are fastened to an upper surface 1116 of the wall 1003 and extend over a portion of the first end 216 and the second end 218 of the core 212, respectively.

FIG. 12 illustrates a section view of the inductor assembly 904 and structure 1000 for supporting the inductor assembly 904 within the transmission 12. As shown in FIG. 12, the first inner surface 1008 and the second inner surface 1110 may include a step 1116 for engaging a lower surface of the core 212 to provide additional support. To avoid any electrical losses due to contact between the core 212 and the transmission 12, an electrically insulative material 1118 is disposed over the core 212 at any potential contact areas.

The inductor assembly 904 is cooled by the transmission fluid 96 within the transmission 12. Heat transfers by conduction from the conductor 210 and the core 212 through the insulative material 1118 and then to wall 1003. The transmission fluid 96 contacts the wall 1003, as well as the conductor 210 and the core 212. Heat transfers from the wall 1003, as well as the conductor 210 and the core 212 to the transmission fluid 96.

The thermal resistance of the heat transfer path from the non-potted inductor assembly 904 to the transmission fluid 96 is low as compared to the thermal resistance of the potted inductor assembly 104 depicted in FIG. 4, due to the elimination of the thermal grease 122, the potting compound 118 and the cold plate 120.

With reference to FIGS. 13-16, a structure for supporting an inductor assembly within the transmission (shown in FIG. 1) is illustrated in accordance with one or more embodiments and is generally referenced by numeral 1300. The structure 1300 includes a first bracket 1330 and a second bracket 1330' that are generally symmetrical to each other. Each bracket 1330, 1330' includes a flange 1334, 1334' for resting upon a transmission wall (not shown). Each flange 1334, 1334' includes holes 1336, 1336' for receiving fasteners (not shown) for mounting the inductor assembly 904 to the transmission, according to one or more embodiments.

Figure 15:
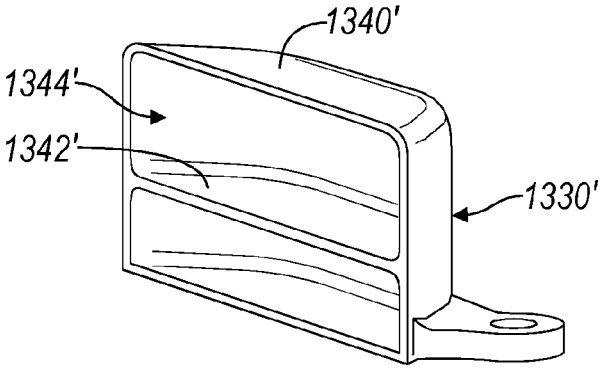
FIG. 15 is a side perspective view of a portion of the structure of FIG. 13.
Figure 16:
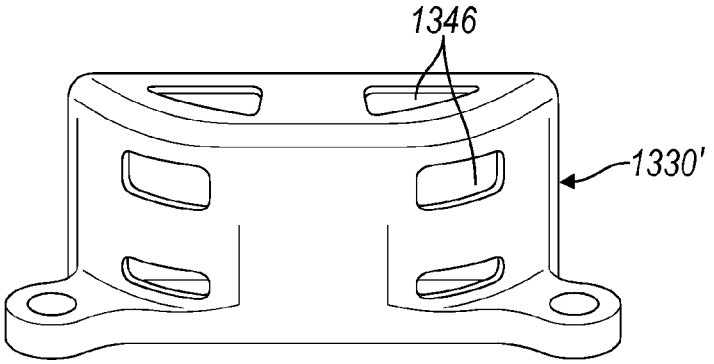
FIG. 16 is a side perspective view of a portion of the structure of FIG. 13, according to another embodiment.
Figure 13:
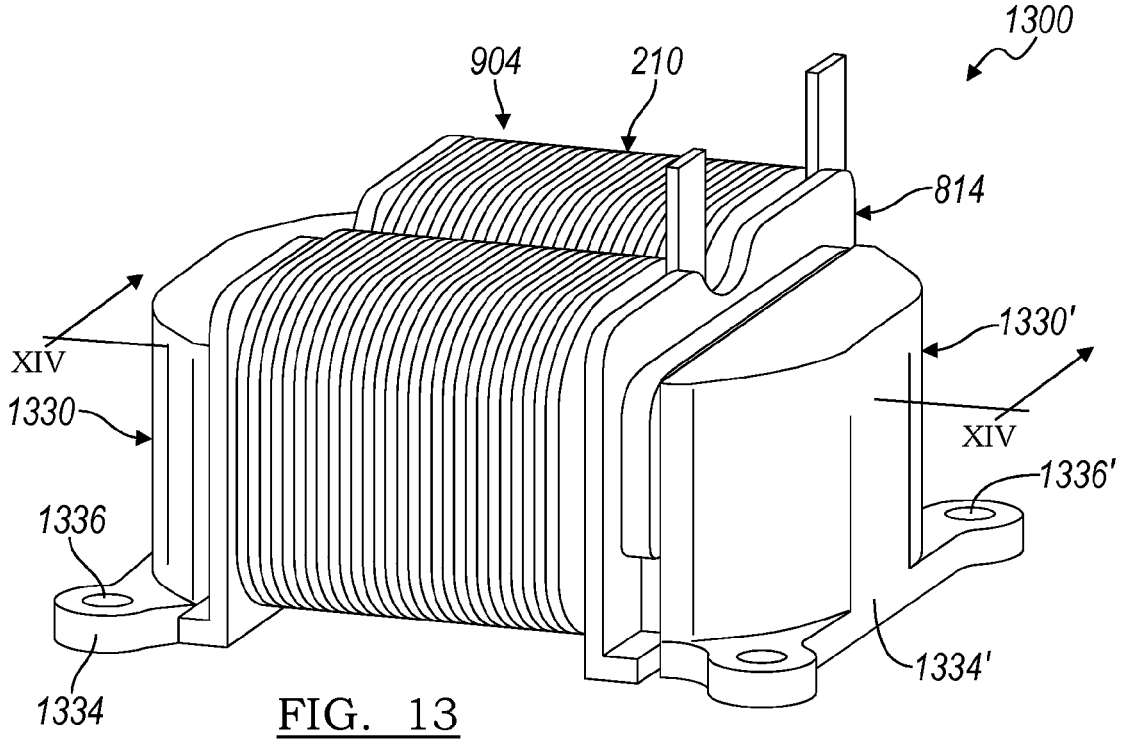
FIG. 13 is a side perspective view of structure for supporting the inductor assembly of FIG. 9 according to another embodiment.
Figure 14:
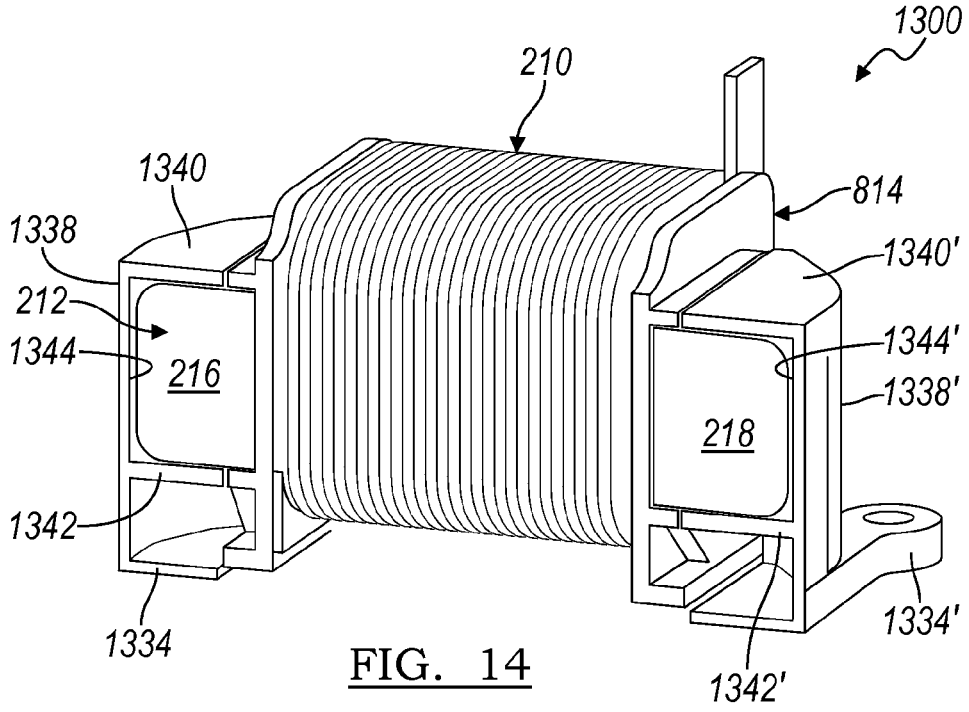
FIG. 14 is a section view of the structure and inductor assembly of FIG. 13 taken along section line XIV-XIV.

Referring to FIGS. 14-16, an upright support 1338, 1338' extends from the flange 1334, 1334'. A top surface 1340, 1340' and an intermediate surface 1342, 1342' extend transversely from the upright support 1338, 1338' to collectively form a pocket 1344, 1344'. The pockets 1344, 1344' are sized for receiving the first end 216 and the second end 218 of the core 212, respectively. The brackets 1330, 1330' are formed of an electrically conductive material, such as cast aluminum, according to one or more embodiments. The brackets 1330, 1330' and/or the core 212 are coated with an insulative material (not shown) at any potential contact points, according to one or more embodiment. Referring to FIG. 16, apertures 1346 may be formed through one or more of the brackets 1330, 1330' for facilitating the flow of the transmission fluid 96 through the structure 1300.

Figure 17:
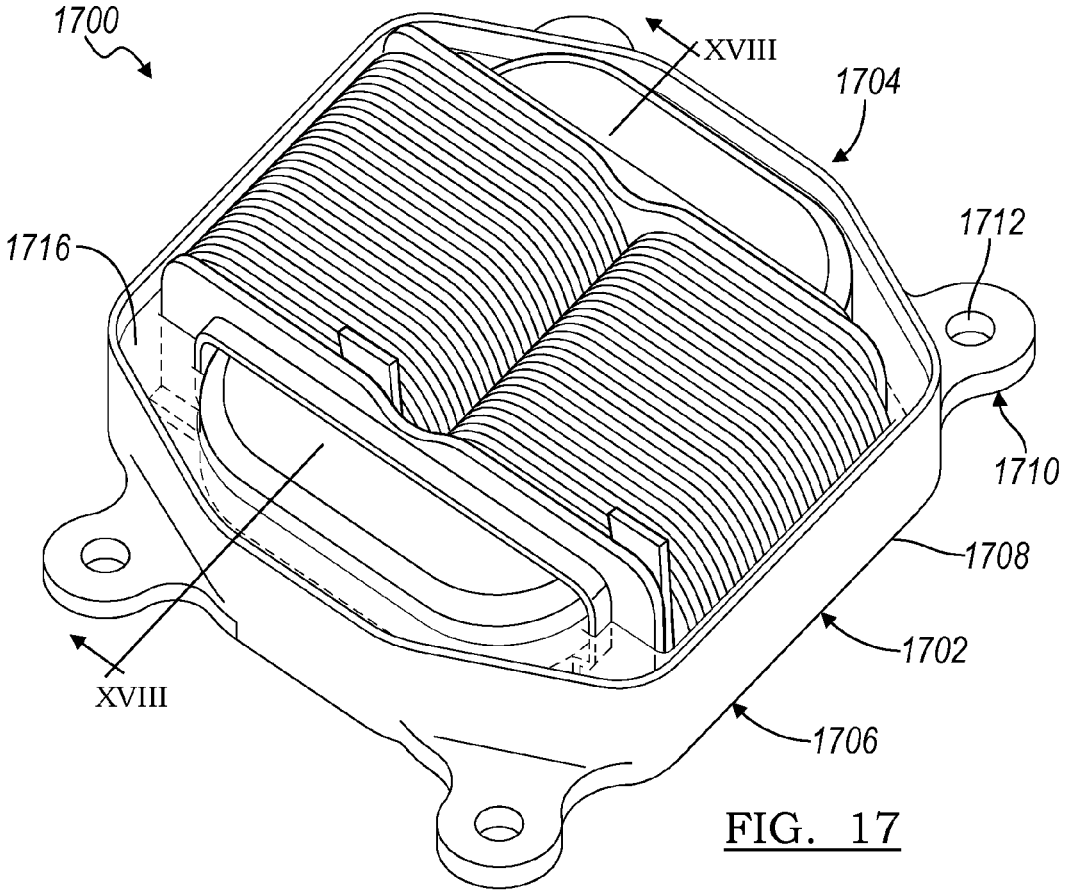
FIG. 17 is a side perspective view of structure for supporting the inductor assembly of FIG. 9 according to another embodiment, illustrating the inductor assembly partially encapsulated in an oil compatible potting compound material.
Figure 18:
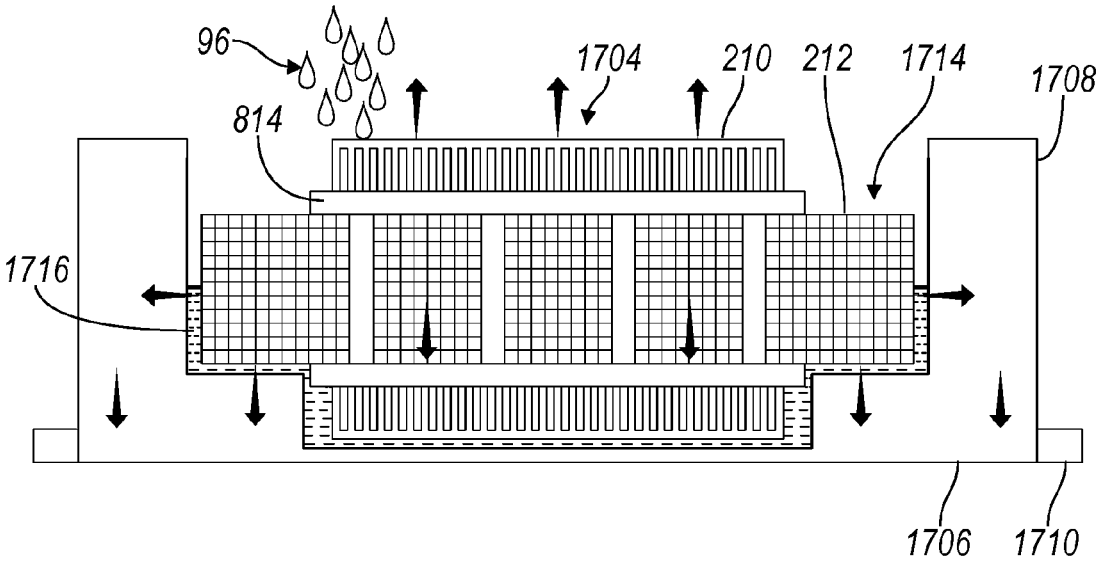
FIG. 18 is a section view of the structure and inductor assembly of FIG. 17 taken along section line XVIII-XVIII.

With reference to FIGS. 17 and 18, a structure for supporting an inductor assembly within the transmission 12 is illustrated in accordance with one or more embodiments and is generally referenced by numeral 1700. The structure 1700 includes a receptacle 1702 for receiving an inductor assembly 1704 therein. The inductor assembly 1704 includes the conductor 210, the core 212 and the insulator 814 as described above with reference to the inductor assembly 904. However, the inductor assembly is referenced by numeral 1704 to indicate that it is partially encased in potting material ("partially potted").

The receptacle 1702 includes a base 1706 and a sidewall 1708 extending transversely from an outer periphery of the base 1706. The base 1706 includes a plurality of flanges 1710 with holes 1712 formed through for receiving fasteners for mounting the receptacle 1702 to the transmission. The sidewall 1708 defines a cavity 1714 for receiving the inductor assembly 1704. The structure 1700 includes adhesive material, such as potting material 1716 that is disposed within the cavity 1714 to encase a lower portion of the inductor assembly 1704. The potting material 1716 secures the partially potted inductor assembly 1704 to the receptacle 1702 while leaving an upper portion of the inductor assembly 1704 exposed for receiving the transmission fluid 96.

FIG. 18 illustrates a section view of the partially potted inductor assembly 1704 and the structure 1700 for supporting the inductor assembly 1704 within the transmission 12. The partially potted inductor assembly 1704 is cooled by the transmission fluid 96 within the transmission 12. Heat transfers by conduction from the conductor 210 and the core 212 through the potting material 1716 and then to the sidewall 1708. The transmission fluid 96 contacts the sidewall 1708, as well as the upper exposed portions of the conductor 210 and the core 212. Heat transfers from the sidewall 1708, as well as the conductor 210 and the core 212 to the transmission fluid 96.

The thermal resistance of the heat transfer path from the partially potted inductor assembly 1704 to the transmission fluid 96 is low as compared to the thermal resistance of the fully potted inductor assembly 104 depicted in FIG. 4, due to the reduction of the potting compound 118. However, the thermal resistance of the partially potted inductor assembly 1704 is greater than the thermal resistance of the non-potted inductor assembly 14, 804, 904. The partially potted inductor assembly 1704 provides additional support to the core 212, as compared to the non-potted inductor assemblies 14, 804, 904 and structures 200, 800, 900, 1300. Thus, the partially potted inductor assembly 1704 supported by the structure 1700 provides a compromise between thermal performance and vibration performance.

As such the non-potted inductor assembly 14, 804, 904, and the partially potted inductor assembly 1704 provides advantages over existing fully potted inductor assemblies, such as inductor assembly 104, by facilitating direct cooling of the conductor and core using transmission fluid. The transmission 12 and/or the inductor assembly 14 include additional structure 200, 800, 900, 1300, 1700 for supporting the inductor assembly 14, 804, 904, 1704 to compensate for the decreased potting material.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle comprising:

a transmission defining a chamber and including a pair of sidewalls that project into the chamber and define a partially encircled recess therebetween; and an inductor assembly mounted between the sidewalls and including an insulator having first and second portions oriented toward each other, each with a base disposed adjacent to one of the sidewalls, a support extending from the base, and a spool extending transversely from the support to engage the other portion, each spool having an external surface for supporting a coil and a cavity extending therethrough for receiving a core, wherein the insulator supports the coil and the core such that the coil is exposed to direct contact with fluid within the chamber to cool the coil.

2. The vehicle of claim 1 wherein the base is formed with at least one aperture extending therethrough for receiving a fastener and for mounting the inductor assembly to the transmission.

3. The vehicle of claim 1 wherein the core further comprises a first end, a second end and first and second legs for interconnecting the first end to the second end to collectively form a ring, wherein the spool further comprises a first spool and a second spool, and wherein each spool is sized for receiving one of the first and second legs therethrough.

4. The vehicle of claim 3 wherein each of the first and second legs further comprises a plurality of core elements with insulative spacers disposed between adjacent core elements to define air gaps.

5. The vehicle of claim 1 wherein the core further comprises at least two apertures formed therethrough and wherein each aperture is sized for receiving a fastener for mounting the inductor assembly to the wall of the transmission.

6. The vehicle of claim 1 further comprising a spring disposed between one of the sidewalls and a first end of the core and imparting a longitudinal force upon the inductor assembly, wherein a second end of the core oriented longitudinally opposite the first end engages the other of the sidewalls such that the longitudinal force retains the inductor assembly within the recess for mounting the inductor assembly to the transmission.

7. The vehicle of claim 6 further comprising at least one plate that extends across the recess and over a portion of the insulator for retaining the inductor assembly within the recess.

8. The vehicle of claim 1, wherein the insulative material further comprises potting compound.

9. The vehicle of claim 1, wherein the inductor assembly does not include a cooling plate.

10. A vehicle comprising:

a transmission including a pair of sidewalls that project into a chamber defined by the transmission to define a partially encircled recess therebetween;

a coil;

a core; and an insulator disposed between the sidewalls and having first and second portions, each with:

a base disposed adjacent to one of the sidewalls, a support extending from the base, and a spool extending transversely from the support to engage the other portion, each with an external surface to support the coil and a cavity to receive the core, wherein the insulator supports the coil and the core such that exposed surface area portions of the coil are exposed to direct contact with fluid within the transmission to cool the coil.

11. The vehicle of claim 10 wherein the exposed surface area portions of the coil are not covered by insulative material.

12. The vehicle of claim 10 wherein the core further comprises a first end, a second end and first and second legs for interconnecting the first end to the second end to collectively form a ring, wherein the spool further comprises a first spool and a second spool, and wherein each spool is sized for receiving one of the first and second legs therethrough.

13. The vehicle of claim 12 wherein each of the first and second legs further comprises a plurality of core elements with insulative spacers disposed between adjacent core elements to define air gaps.

14. The vehicle of claim 10 wherein the core further comprises at least two apertures formed therethrough and wherein each aperture is sized for receiving a fastener for mounting the insulator to the wall of the transmission.

15. A vehicle comprising:

a transmission defining a chamber and including a pair of sidewalls that project from a wall of the transmission and define a partially encircled recess therebetween;

a coil;

a core; and an insulator disposed between the sidewalls within the recess and adapted to support the coil and the core such that portions of the coil are exposed to direct contact with fluid within the chamber to cool the coil.

16. The vehicle of claim 15, wherein the insulator further comprises first and second portions, each with:

a base to be disposed adjacent one of the sidewalls;

a support extending from the base; and a spool extending transversely from the support to engage the other portion and defining a cavity for receiving the core.

* * * * *